United States Patent [19]

Numata et al.

[11] Patent Number: 4,853,609

[45] Date of Patent: Aug. 1, 1989

[54] DISTORTION-FREE, OPPOSITE-PHASE CURRENT SOURCE

[75] Inventors: Tatsuo Numata; Tadashi Noguchi, both of Tokyo, Japan

[73] Assignee: Pioneer Electronic Corporation, Tokyo, Japan

[21] Appl. No.: 502,806

[22] Filed: Jun. 9, 1983

[30] Foreign Application Priority Data

Jun. 9, 1982 [JP] Japan ..... 57-84669[U]

[51] Int. Cl.[4] ..... G05F 3/08

[52] U.S. Cl. ..... 323/312; 323/315; 323/316

[58] Field of Search ..... 307/296 R, 297; 323/312, 315, 316, 280, 313; 330/146, 259

[56] References Cited

U.S. PATENT DOCUMENTS

| | | | |
|---|---|---|---|
| 3,909,738 | 9/1975 | Niimi | 323/315 |
| 4,004,247 | 1/1977 | Van de Plassche | 323/315 |
| 4,216,435 | 8/1980 | Ahmed | 330/259 |
| 4,296,383 | 10/1981 | Jeandot et al. | 330/259 |
| 4,442,400 | 4/1984 | Nagano | 323/315 |

*Primary Examiner*—Patrick R. Salce
*Assistant Examiner*—Jeff Sterrett
*Attorney, Agent, or Firm*—Sughrue, Mion, Zinn, Macpeak & Seas

[57] ABSTRACT

An opposite-phase current source is improved by eliminating the conventionally employed current mirror circuits, and by instead using a pair of transistor current sources subjected to voltage feedback and emitter-connected via a resistor. A constant current source or sources are coupled to the opposite ends of the resistor or to a mid-point thereof.

3 Claims, 2 Drawing Sheets

DISTORTION-FREE, OPPOSITE-PHASE CURRENT SOURCE

BACKGROUND OF THE INVENTION

The present invention relates to distortion-free, opposite-phase current sources which can be used in electronic variable controlled amplifiers, electronic controllers or the like.

Heretofore, an opposite-phase current source has been known such as shown in FIG. 1, in which transistors $Q_1$, $Q_2$, $Q_3$ and $Q_4$ are provided with the same characteristics, and resistors $R_1$, $R_2$, $R_3$ and $R_4$ connected to emitters of the respective transistors have the same resistance value. The transistors $Q_1$ and $Q_4$ form an opposite-phase current source, which is connected to an electronic tone controller 1. The bases of the transistor $Q_1$ and $Q_2$ are connected to each other so as to form two current mirror circuits. The parallel-connected transistors $Q_2$ and $Q_3$ are connected in series to a constant current source 2 so as to operate as a subtraction circuit. The bases of the transistors Q3 and Q4 are connected to each other so as to form two current mirror circuits, which act as a source of current. The amount of current flowing from the constant current source 2 is determined so as to be twice as large as the collector current of the transistor $Q_1$ at the time when no input signal is applied. Accordingly, when no input signal is being received, equal collector currents flow in the four transitors $Q_1$ through $Q_4$.

When an a.c. signal is applied to an input terminal 3, the signal thus applied is translated into a current with the aid of the transistor $Q_1$. The current flowing in the transistor $Q_1$ in turn flows through the transistor $Q_2$. The current flow from the constant current source 2 is subtracted from by the current flowing through the transistor $Q_2$, and an opposite-phase current flows through the transistor $Q_3$. The same amount of current flowing through the transistor $Q_3$ also flows through the transistor $Q_4$. Consequently, oppositephase currents are obtained from the transistor $Q_1$ and $Q_4$.

In the circuit arranged as described above, there is a disadvantage in that due to distortions or noise produced by the two current mirror circuits, the opposite-phase current taken out from the transistor $Q_4$ is distorted.

SUMMARY OF THE INVENTION

Accordingly, an object of the invention is to provide an opposite-phase current source in which the above-noted drawbacks accompanying the conventional devices are entirely eliminated while eliminating the current mirror circuits.

The features of the opposite-phase current source according to the invention reside in that emitters of a pair of current sources, each of which comprises a transistor subjected to voltage feedback, are connected to each other through a resistor, and a constant current source is coupled in series to the thus connected pair of current sources. The opposite-phase current source thus arranged is capable of completely eliminating distortion and noise, which are otherwise produced from the conventional devices in which current mirror circuits are employed.

DETAILED DESCRIPTION OF THE PREFERRED EMBODIMENTS

A first preferred embodiment of the invention will now be described with reference to the accompanying drawings.

Figure 1:
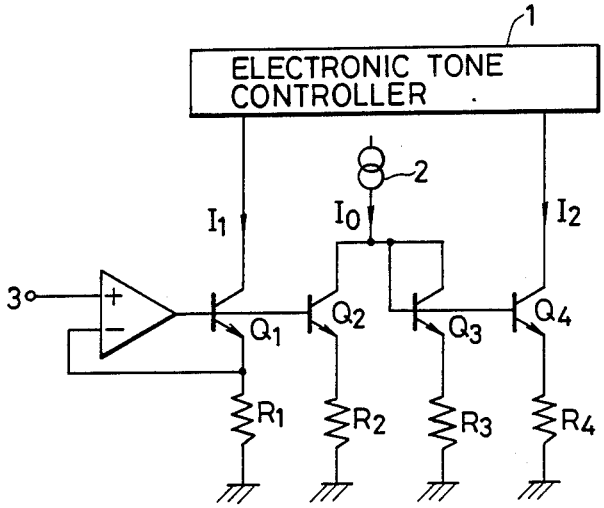
FIG. 1 PRIOR ART
FIG. 1 is a circuit diagram showing a conventional opposite-phase current source.
Figure 2:
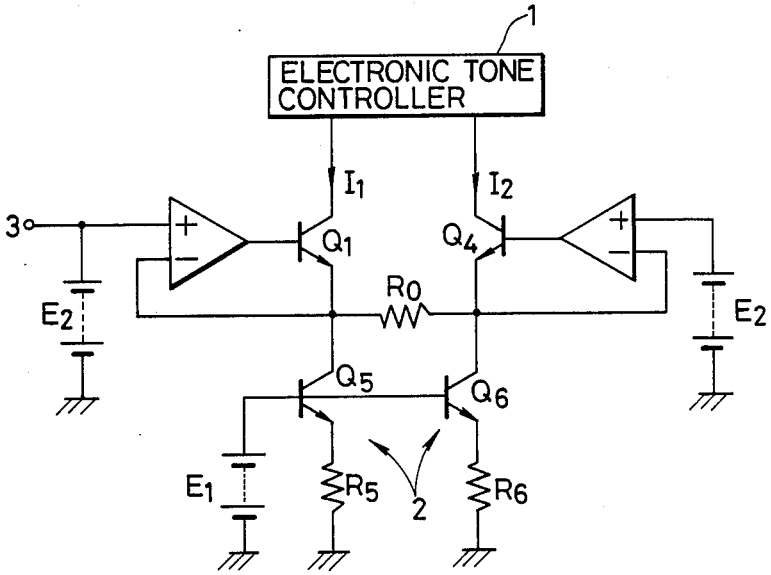
FIG. 2 is a current diagram showing a first embodiment of the opposite-phase current source according to the invention.

In FIG. 2, transistors $Q_1$ and $Q_4$ are subjected to voltage feedback by well-known operational amplifiers. Constant current sources comprising transistors $Q_5$ and $Q_6$, to the bases of which a constant voltage $E_1$ is applied, are coupled serially to the transistors $Q_1$ and $Q_4$. A resistor $R_O$ is connected between the emitters of the transistors $Q_1$ and $Q_4$. The bases of the transistors $Q_1$ and $Q_4$ are biased with the same voltage and the same collector currents flow through the transistors $Q_1$ and $Q_4$ when no input signal is being received.

When an a.c. current is applied to an input terminal 3, the voltage developed at the emitter of the transistor $Q_1$ varies corresponding to the input signal. The voltage at the emitter of the transistor $Q_4$ is, on the other hand, unchanged, so that a current flows in the resistor $R_0$ is proportional to the voltage differential between the emitters of the transistors $Q_1$ and $Q_4$.

The sum of the collector currents $I_1$ and $I_2$ of the transistors $Q_1$ and $Q_4$ are held constant by the two constant current of the transistor $Q_1$ renders the collector current of the transistor $Q_4$ inversely decreased, and vice versa.

The emitter voltage of the transistor $Q_1$ is exactly in proportion to the input signal, and the current flowing through the resistor $R_0$ is also exactly in proportion to the input signal. Consequently, distortion-free, opposite-phase currents are taken out from the transistors $Q_1$ and $Q_4$.

Figure 3:
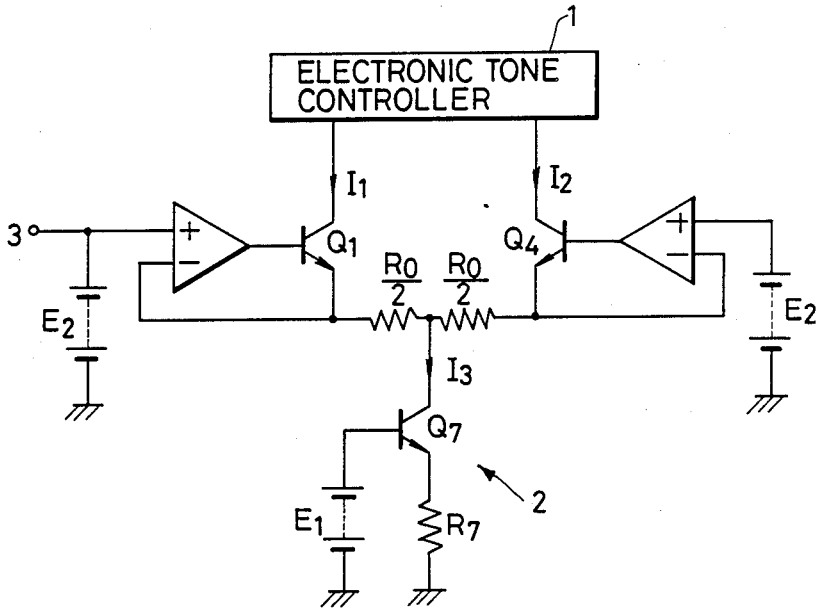
FIG. 3 is a circuit diagram showing a second embodiment of the opposite-phase current source according to the invention.

FIG. 3 is a circuit diagram showing a second embodiment of the invention. This embodiment is similar to the first embodiment described above but differs therefrom in that a single constant current source is connected to the mid-point of the resistor $R_0$, as opposed to the case of the first embodiment in which two constant current sources were connected in series to the transistors $Q_1$ and $Q_2$, respectively. The operation of the second embodiment is similar to that of the first embodiment.

As described, according to the invention, the emitters of two current sources, each of which comprises a transistor being subjected to voltage feedback, are connected to each other via a resistor, and are connected in series to one or two constant current sources. With the circuit thus arranged, opposite-phase currents may be provided without employing current mirror circuits as is done in the conventional devices. Furthermore, the circuit is capable of eliminating the distortion and noise inherent in the use of the current mirror circuits.

In the above-described embodiment, although bipolar transistors are used for the elements constituting the opposite-phase current source, it is possible to use FETs.

What is claimed is:

1. An opposite-phase current source, having no current mirror circuits therein, comprising;

two current sources, each of said sources comprising a transistor having an emitter, base and collector;

a voltage feedback circuit for each of said current sources, each said feedback circuit comprising a loop between said emitter and said base of each of said transistors;

a resistor element connected between said emitters of the transistors of said two current sources;

constant current source means coupled to said resistor element, said constant current source means comprising a pair of constant current sources, each serially connected to a respective one of said emitters, and coupled on opposite sides of said resistor element;

whereby two opposite-phase currents are produced at said collectors of said transistors when an input signal is applied to one of said bases of said transistors.

2. An opposite-phase current source, having no current mirror circuits therein, comprising;

two current sources, each of said sources being subjected to voltage feedback and comprising a transistor having an emitter, base and collector;

a resistor element connected between said emitters of the transistors of said two current sources;

constant current source means coupled to said resistor element;

whereby two opposite-phase currents are produced at said collectors of said transistor when an input signal is applied to one of said bases of said transistors; and wherein said constant current source means comprises a pair of constant current sources, each serially connected to a respective one of said emitters, and coupled on opposite sides of said resistor element.

3. A device as claimed in claim 2, wherein the transistors of said constant current sources are coupled at the bases thereof.

* * * * *